US005277510A

United States Patent [19]

Okamoto et al.

[11] Patent Number: 5,277,510

[45] Date of Patent: Jan. 11, 1994

[54] APPLICATOR WITH SPRING BIASED BALL

[75] Inventors: Hideshi Okamoto; Noriso Tsugawa, both of Tokyo, Japan

[73] Assignee: Sailor Pen Co. Ltd., Tokyo, Japan

[21] Appl. No.: 984,202

[22] Filed: Nov. 30, 1992

[30] Foreign Application Priority Data

Dec. 11, 1991 [JP] Japan ..... 3-109324
Jan. 22, 1992 [JP] Japan ..... 4-6271
Mar. 27, 1992 [JP] Japan ..... 4-25387

[51] Int. Cl.[5] ..... B43K 7/00; B43K 7/10; B43K 7/12

[52] U.S. Cl. ..... 401/214; 401/186

[58] Field of Search ..... 401/214, 186

[56] References Cited

U.S. PATENT DOCUMENTS

| | | | |
|---|---|---|---|
| 554,189 | 2/1896 | Kochendarfer | 401/214 |
| 600,299 | 3/1898 | Werner | 401/214 |
| 2,122,580 | 7/1938 | Morris | 401/214 |
| 2,440,829 | 5/1948 | O'Connor | 401/214 X |
| 3,000,355 | 9/1961 | Rosenthal | 401/186 |

FOREIGN PATENT DOCUMENTS

| | | | |
|---|---|---|---|
| 279362 | 11/1924 | Fed. Rep. of Germany | 401/214 |
| 1209912 | 1/1966 | Fed. Rep. of Germany | 401/214 |
| 461361 | 12/1913 | France | 401/214 |
| 950038 | 9/1949 | France | 401/214 |
| 1071169 | 3/1954 | France | 401/214 |

*Primary Examiner*—Steven A. Bratlie
*Attorney, Agent, or Firm*—Frishauf, Holtz, Goodman & Woodward

[57] ABSTRACT

An applicator which allows easy control of fluid discharge and also smooth application of the fluid contained therein with no excessive discharge includes a fluid tank, filled with a fluid to be applied, and connected to a stem retaining a ball therein, the ball being rotatably retained in a ball housing formed in the stem in such a way that the ball may partly appear from the tip of the stem and is pushed outward by the outer end face of a movable piece, protruding slightly into the ball housing, resiliently urged by a spring, so as to allow the ball to be normally in contact with the inner caulked edge of the stem, while the ball is also designed to roll in contact with the seat of the ball housing when the fluid is being applied.

6 Claims, 3 Drawing Sheets

APPLICATOR WITH SPRING BIASED BALL

BACKGROUND OF THE INVENTION

This invention relates to an applicator to which a highly viscous fluid to be applied such as correction fluid and make-up fluid is charged.

Most of such applicators have an application member attached to the tip of a fluid tank molded using a flexible material and a valve mechanism disposed behind the application member. When the applicator is used, the tip of the application member is pressed against a surface to be treated to open the valve, and in this state the fluid tank is pressed to squeeze out a highly viscous fluid such as correction fluid therefrom and feed it to the application member. When the application member is of a spherical form, it is housed in a stem having a tubular form whose tip is caulked in such a way that the ball may partly be exposed from the tip of the stem and pushed outward by the outer end of a movable piece resiliently urged by a spring. In other words, when the applicator is not used, the spherical application member or ball is brought into intimate contact with the inner caulked edge of the stem, and thus these members constituting a valve structure are designed not to discharge the fluid in this state.

When the ball is pressed against the surface to be treated for application in such type of applicator, the ball is retracted from the inner caulked edge of the stem to assume an open valve structure. However, since the stem has a tubular form, the ball is fully embedded therein if the applicator is pressed strongly against the surface to be treated. Accordingly, the valve structure remains wide open to discharge the fluid excessively. Namely, the discharge varies depending on the pressure applied to the surface to be treated, making it difficult to control discharge of the fluid.

While the ball rolls in contact with the outer end face of the movable piece resiliently urged by the spring, the contact area is narrow and the movable piece is unstable since it is resiliently urged by the spring to be movable. Accordingly, the ball does not roll smoothly, making the application procedure difficult.

OBJECT AND SUMMARY OF THE INVENTION

Under such circumstances, the present invention is directed to provide an applicator which allows easy control of fluid discharge and also smooth application of the fluid contained therein with no excessive discharge.

In order to attain the intended object, in the applicator according to the present invention, a flexible fluid tank, in which a highly viscous film-forming fluid to be applied is contained, is connected to a stem retaining a spherical application member or ball therein. The stem has a fluid path defined therein and rotatably retains the ball in a ball housing formed contiguous to the fluid path in such a way that the ball may partly appear from the tip of the chip; and the ball is pushed outward by the outer end face of a movable piece, protruding slightly into the ball housing, resiliently urged by a spring or directly by the spring, whereby to allow the ball to normally be in contact with the inner tapered edge of the stem. The ball is also designed to roll in contact with the seat of the ball housing when the fluid is being applied. Otherwise, a small mass spring is disposed in the stem to urge the ball directly or via the outer end face of the movable piece resiliently urged by the spring to allow the ball to normally be in contact with the inner tapered edge of the stem, and the ball is designed to roll in contact with the seat of the ball housing when the fluid is being applied.

Since the ball is pushed outward by the outer end face of the movable piece resiliently urged by the spring, the ball is brought into intimate contact with the inner tapered edge of the stem to prevent discharge of the fluid when the applicator is not used. However, since the ball rolls in contact with the seat of the ball housing when the fluid is being applied, the ball is prevented from being fully embedded into the stem, and discharge of the fluid can easily be controlled. Thus the fluid can be applied smoothly onto the surface to be treated with no excessive discharge. If the spring is designed to have a rod portion extending from one end thereof so as to push the ball by this rod portion, the number of parts can advantageously be reduced. If a small mass spring is disposed in the stem to allow it to urge the ball directly or via the outer end face of the movable piece resiliently urged by the spring, the ball can be prevented from slipping off the tip of the stem, since the inertia of spring is small even when a great impact is applied to the applicator, and the spring and movable piece push the ball weakly.

BRIEF DESCRIPTION OF THE DRAWINGS

The features of this invention that are believed to be novel are set forth with particularity in the appended claims. The invention, together with the objects and advantages thereof, may best be understood by reference to the following description of the preferred embodiments taken in conjunction with the accompanying drawings in which:

DETAILED DESCRIPTION OF PREFERRED EMBODIMENTS

Figure 1:
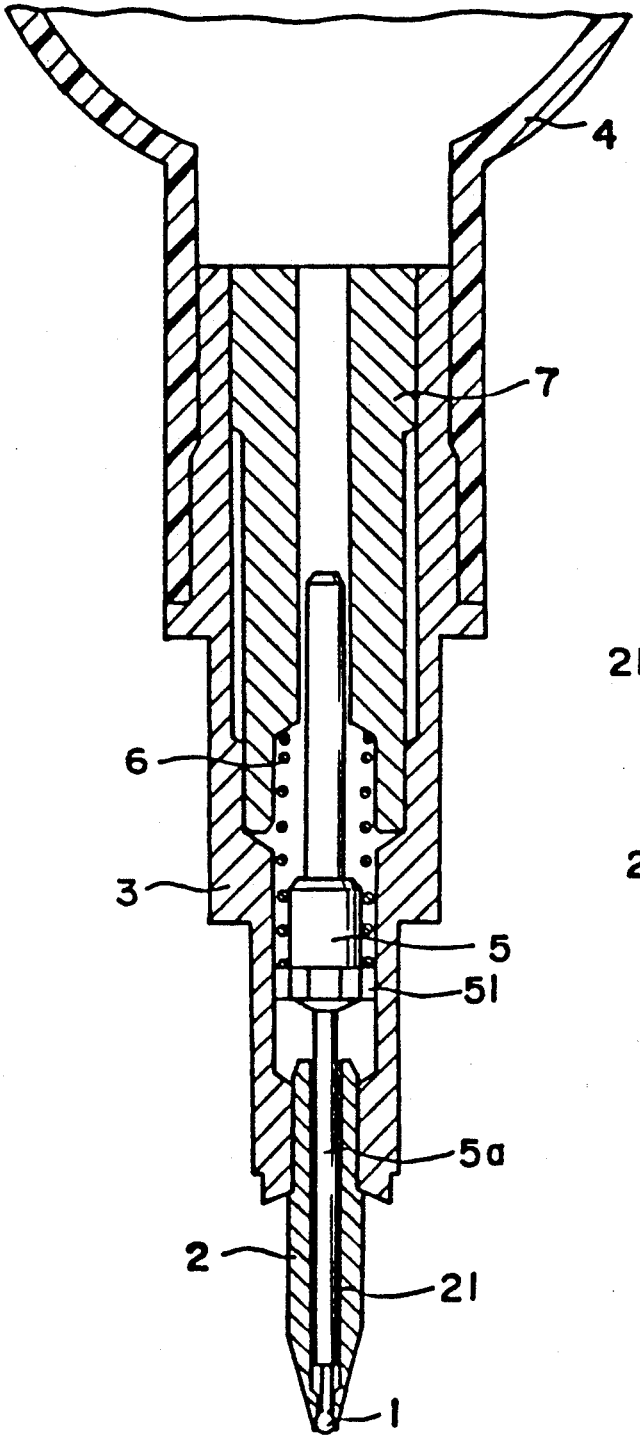
FIG. 1 shows in cross-sectional view the applicator according to a first embodiment of the present invention.

The present invention will now be described below specifically based on the embodiments shown in the attached drawings. FIG. 1 shows a first embodiment of the present invention, in which a stem 2 having a fluid path 21 defined therein rotatably retains a ball 1 at the tip thereof. The stem 2 is held in a holder 3 to which a fluid tank 4 molded using a flexible material is connected. A bar-like movable piece 5 is disposed in the holder 3, and the front side portion 5*a* of the movable piece 5 is inserted into stem 2. Meanwhile, a cylindrical part 7 is telescopically press-fitted in the holder 3, and a spring 6 is interposed between the cylindrical part 7 and a flange 51 of the movable piece 5 so as to resiliently urge the movable piece 5 outward. The space in the tank 4 communicating with the fluid path 21 is filled with a fluid to be applied, for example, a correction fluid having a viscosity of 30 to 40 cps and high film-forming properties.

Figure 2:
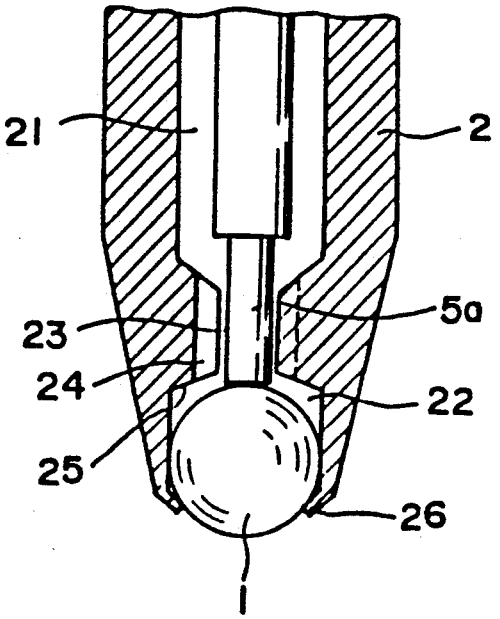
FIG. 2 shows in cross-sectional view the major portion of the stem in the first embodiment.

As shown in FIG. 2, the ball 1 is retained in a ball housing 22 of the stainless steel stem 2 to be movable forward and backward, for example, in the range of about 5 to 15 μm and exposed partially from the tip of the stem 2. The ball housing 22 communicates with the fluid path 21 via a central bore 23 and vertical grooves 24 defined radially. The front side portion 5a of the movable piece 5 inserted with the fluid path 21 is urging the ball 1 outward, in the state where it is slightly projecting forward from the seat 25 of the ball housing 22, in other words, where the ball 1 can be brought into contact with the seat 25 when the ball 1 is pushed backward, for example, by about 5 to 15 μm, allowing the ball 1 to be normally in contact with the opening edge 26 of the stem 2.

To describe typically the dimensions of the respective parts, the ball 1 made of a super hard material has a diameter of 0.7 mm and the ball housing 22 has an inner diameter of 0.72 to 0.73 mm. While the opening edge 26 of the stem 2 is tapered after the ball 1 is housed in the ball housing 22, the ball 1 is punched backward after tapering so as to deform the seat 25 of the ball housing 22 to sink by 10±3 μm. Accordingly, the ball 1 can move forward and backward in the range of 7 to 13 μm. As described above, the clearance between the ball 1 and the ball housing 22 is comparatively small for the applicator for discharging a highly viscous fluid.

Figure 3:
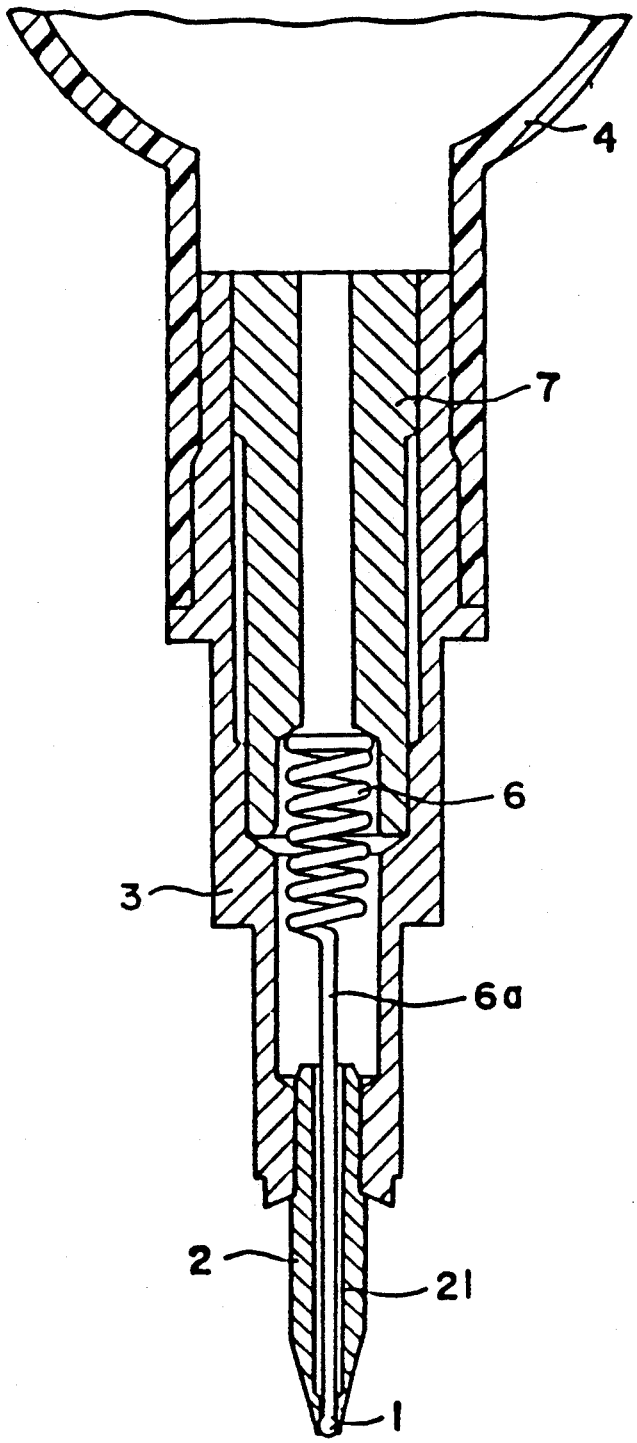
FIG. 3 shows in cross-sectional view the applicator according to a second embodiment of the present invention.

In a second embodiment shown in FIG. 3, a spring 6 is disposed in the holder 3, and the spring 6 has a rod portion 6a formed integrally to extend from one end thereof, which is inserted with the stem 2. Namely, the movable piece 5 is omitted. A cylindrical part 7 is telescopically press-fitted into the holder 3 against which the other end of the spring 6 is abutted. Accordingly, the rod portion 6a is resiliently urged outward to directly push the ball 1 outward.

Figure 4:
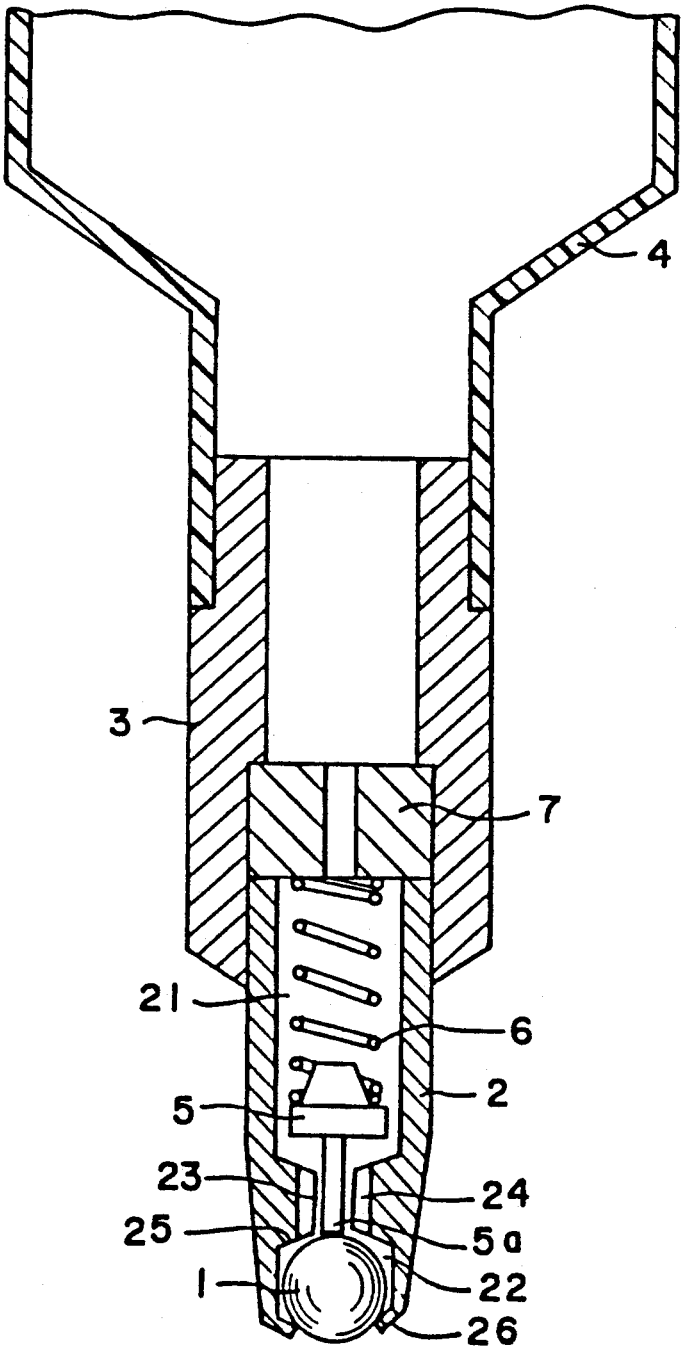
FIG. 4 shows in cross-sectional view the applicator according to a third embodiment of the present invention.

Now, referring to a third embodiment shown in FIG. 4, a small mass movable piece 5 and a small mass spring 6 are disposed in the fluid path 21 of the stem 2. The front side portion 5a of the movable piece 5 is inserted into the ball housing 22 of the stem 2. A cylindrical part 7 is telescopically press-fitted in the holder 3, and a small spring 6 is interposed between the cylindrical part 7 and the movable piece 5, so that the movable piece can be resiliently urged outward, in turn, to push the ball outward. Otherwise, the movable piece 5 may be omitted, and instead a spring having a rod portion extending from one end thereof may be inserted into the ball housing 22 so as to directly urge the ball 1 therewith.

When the applicator is used, the fluid tank 4 is pressed with fingers to reduce the inner volume thereof, and the ball 1 is soaked with the fluid to be applied. When the applicator is moved with the ball thereof being pressed against a surface to be treated, the ball 1 retracts against the resilience of the spring 6 and rolls in contact with the seat 25 discharging the fluid. The ball 1 thus rolls unreluctantly since it rolls in contact with the seat 25, and the fluid can smoothly be applied to the surface to be treated. Besides, since the ball 1 is immediately brought into contact with the seat 25, the fluid is prevented from being discharged excessively.

As has been described heretofore, the applicator according to the present invention discharges no fluid to be applied since the ball is brought into intimate contact with the inner caulked edge of the stem when the applicator is not used, but the retracting ball is designed to be immediately brought into contact with the seat of the ball housing defined in the stem and rolls in this state when the applicator is used, so that the discharge of the fluid can easily be controlled. Accordingly, the applicator according to the present invention allows smooth application of the fluid to be applied with no excessive discharge. Meanwhile, a small mass spring and a small mass movable piece, if disposed in the stem so as to urge the ball, can provide a small inertia of spring to exert a small force of pushing the ball, whereby to prevent slipping off of the ball from the tip of the stem.

Although three embodiments of the present invention have been described herein, it should be apparent to those skilled in the art that the present invention may be embodied in many other specific forms without departing from the spirit or scope of the invention.

What is claimed is:

1. An applicator comprising:

flexible fluid tank means for containing a highly viscous film-forming fluid to be applied, said tank means having an open end;

a ball;

stem means for retaining said ball therein, said stem means being connected to said flexible fluid tank means to receive said fluid therefrom, said stem means including:

a fluid path for receiving said fluid, said fluid path always being in open communication with said flexible fluid tank means for receiving said fluid therefrom, ball housing means for rotatably retaining said ball therein, said ball housing means including a fixed seat and an open edge having an inner tapered portion, such that said ball may partly extend from said open edge and said ball is restricted in movement between said inner tapered portion and said seat, and said ball housing means being formed contiguous to said fluid path;

holder means for connecting said stem means to said tank means, said holder means having one end connected to said open end of said tank means and an opposite end connected to said stem means;

a movable piece having an outer end face in contact with said ball, said movable piece protruding slightly into said ball housing means, and said movable piece being slidably guided within said holder means; and spring means positioned in said holder means for normally biasing said movable piece to push said ball outwardly so that said ball is in contact with the inner tapered portion of said open edge of said stem means when fluid is not being applied, while permitting rolling movement of said ball when said ball is in contact with the seat of said ball housing means and when the fluid is being applied.

2. An applicator according to claim 1, wherein said one end of said holder means is inserted within said open end of said tank means, and an end of said stem means opposite said ball housing means is inserted within said opposite end of said holder means so that there is fluid communication from said tank means, through said holder means and to said stem means.

3. An applicator according to claim 1, wherein said holder means includes a stop, said movable piece slidably extends through said holder means and said stem means, and said spring means is housed in said holder means between said stop and said movable piece.

4. An applicator comprising:

flexible fluid tank means for containing a highly viscous film-forming fluid to be applied;

a ball;

stem means for retaining said ball therein, said stem means being connected to said flexible fluid tank means to receive said fluid therefrom, said stem means including:

a fluid path for receiving said fluid, said fluid path always being in open communication with said flexible fluid tank means for receiving said fluid therefrom, ball housing means for rotatably retaining said ball therein, said ball housing means including a seat and an open edge having an inner tapered portion, such that said ball may partly extend from said open edge, and said ball housing means being formed contiguous to said fluid path; and spring means for normally biasing said ball outwardly so that said ball is in contact with an inner tapered portion of said open edge of said stem means when fluid is not being applied, while permitting rolling movement of said ball when said ball is in contact with the seat of said ball housing means and when the fluid is being applied, said spring means including a spring portion and a rod portion integrally formed with said spring portion, said rod portion having a free end which contacts said ball to impart a biasing force from the spring portion to the ball.

5. An applicator comprising:

flexible fluid tank means for containing a highly viscous film-forming fluid to be applied, said tank means having an open end;

a ball;

stem means for retaining said ball therein, said stem means being connected to said flexible fluid tank means to receive said fluid therefrom, said stem means including:

a fluid path for receiving said fluid, said fluid path always being in open communication with said flexible fluid tank means for receiving said fluid therefrom, ball housing means for rotatably retaining said ball therein, said ball housing means including a fixed seat and an open edge having an inner tapered portion, such that said ball may partly extend from said open edge and said ball is restricted in movement between said inner tapered portion and said seat, and said ball housing means being formed contiguous to said fluid path;

holder means for connecting said stem means to said tank means, said holder means having one end connected to said open end of said tank means and an opposite end connected to said stem means; and small mass spring means disposed entirely in said stem means for normally biasing said ball outwardly so that said ball is in contact with an inner tapered portion of said open edge of said stem means when fluid is not being applied, while permitting rolling movement of said ball when said ball is in contact with the seat of said ball housing means and when the fluid is being applied.

6. An applicator according to claim 5, further including a movable piece positioned in said stem means between said spring means and said ball such that said spring means normally biases said movable piece to push said ball outwardly so that said ball is in contact with the inner tapered portion when fluid is not being applied.

* * * * *